US007455176B2

(12) United States Patent
Focke et al.

(10) Patent No.: US 7,455,176 B2
(45) Date of Patent: Nov. 25, 2008

(54) CIGARETTE PACKAGE

(75) Inventors: Heinz Focke, deceased, late of Verden (DE); by Doris Focke, legal representative, Verden (DE); by Jürgen Focke, legal representative, Verden (DE); Viktor Hein, Verden (DE); Reinhard Lohmann, Scheessel (DE); Hans Schönberger, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 378 days.

(21) Appl. No.: 10/512,682

(22) PCT Filed: Apr. 12, 2003

(86) PCT No.: PCT/EP03/03811

§ 371 (c)(1),
(2), (4) Date: Oct. 27, 2004

(87) PCT Pub. No.: WO03/093136

PCT Pub. Date: Nov. 13, 2003

(65) Prior Publication Data

US 2005/0224375 A1 Oct. 13, 2005

(30) Foreign Application Priority Data

Apr. 30, 2002 (DE) ..... 102 19 464

(51) Int. Cl.
*B65D 85/10* (2006.01)

(52) U.S. Cl. ..... 206/268; 206/273; 229/160.1

(58) Field of Classification Search ..... 206/242, 206/265, 268, 271, 273; 229/87.13, 160.1
See application file for complete search history.

(56) References Cited

U.S. PATENT DOCUMENTS

| | | | | |
|---|---|---|---|---|
| 5,044,550 | A | 9/1991 | Lamm | |
| 5,097,948 | A | 3/1992 | Campbell | |
| 5,435,440 | A * | 7/1995 | Focke et al. | 206/271 |
| 5,478,011 | A | 12/1995 | Pham | |
| 6,003,759 | A | 12/1999 | Kenner | |
| 6,276,600 | B1 * | 8/2001 | Rigby | 206/273 |
| 6,311,834 | B1 | 11/2001 | Focke et al. | |
| 6,370,846 | B1 | 4/2002 | Schoch et al. | |
| 6,742,651 | B1 * | 6/2004 | Focke et al. | 206/268 |

FOREIGN PATENT DOCUMENTS

| | | |
|---|---|---|
| CN | 96112969.7 | 9/1996 |
| CN | 98806987.3 | 7/1998 |
| DE | 1029464 | 5/1958 |
| DE | 31 16 924 A1 | 2/1983 |
| DE | 197 30 266 A1 | 1/1999 |
| DE | 201 01 554 U1 | 4/2001 |
| DE | 100 31 319 A1 | 1/2002 |
| EP | 204 933 B1 | 4/1988 |

(Continued)

*Primary Examiner*—Luan K Bui
(74) *Attorney, Agent, or Firm*—Sughrue Mion, PLLC

(57) ABSTRACT

A cigarette pack of the hinge-lid-box type is provided with predominantly or fully rounded side walls (19, 20) and lid side walls (24, 25). The side walls here are made up of a plurality of rounded regions with different radii, and also with a planar central side strip.

4 Claims, 5 Drawing Sheets

FOREIGN PATENT DOCUMENTS

| | | | |
|---|---|---|---|
| EP | 414 532 | A1 | 2/1991 |
| EP | 545 723 | A1 | 6/1993 |
| EP | 764 594 | A1 | 3/1997 |
| EP | 1 019 304 | B1 | 7/1998 |
| EP | 941 943 | A1 | 9/1999 |
| JP | 4-297446 | A | 10/1992 |
| WO | WO 99/02428 | | 1/1999 |
| WO | WO 00/51912 | A1 | 8/2000 |
| WO | WO 02/49940 | A1 | 6/2002 |
| WO | WO 02/060769 | A1 | 8/2002 |

* cited by examiner 12
25
32
16
34
13
33
20
35
31
41
42
28
22
42
37
31
24
32
34
36
19
39
29
11
37
35
17
26

12
36
25
IX
20
35
11
40
36
26
22
17
39
35
29
40
37
36
24
31
IX
19

CIGARETTE PACKAGE

DESCRIPTION

The invention relates to a cigarette pack of the hinge-lid-box (hinge-lid-pack) type, comprising a box part, a lid connected thereto and a collar, the box part and lid forming corresponding, upright front and rear pack edges with a round cross section—round edges.

Hinge-lid boxes with rounded pack edges are known (EP 0 204 933). The rounded portion of the pack edges, in the case of this known configuration, is adapted to the dimensions of the cigarettes, that is to say to the radius of a cigarette.

The object of the invention is for a cigarette pack or hinge-lid box with round edges to be developed further and improved so as to achieve improved handling and a higher degree of stability for the pack without more material being used.

In order to achieve this object, the cigarette pack according to the invention is defined in that an (imaginary) radius of the round edges is considerably larger than the radius of a cigarette, that is to say it has, in particular, a radius of 6 mm to 10 mm, preferably of approximately 8 mm. The radius of a cigarette is approximately 3.8 mm.

As a result of the configuration of the round edges according to the invention, the greatest part of the side walls of the packs is formed by the rounded portions or round edges. A side strip of side walls of the packs, this side strip being defined between the round edges, is planar according to one particular embodiment of the pack, and according to another embodiment is likewise rounded with a radius considerably larger than the radius of the round edges.

The configuration of the pack according to the invention ensures material-saving production. Furthermore, handling by the user is improved on account of the pronounced rounded portions. Finally, the latter also give rise to increased dimensional stability of the pack overall.

One special feature is the configuration of the blanks, to be precise, on the one hand, in respect of the preparation of folding tabs for forming the rounded portions and, on the other hand, in respect of the configuration of corner tabs which, in the region of a base wall and of an end wall, on account of the geometrical shape and arrangement, give rise to an increase in the dimensional stability in the region of the rounded portions.

Figure 2:
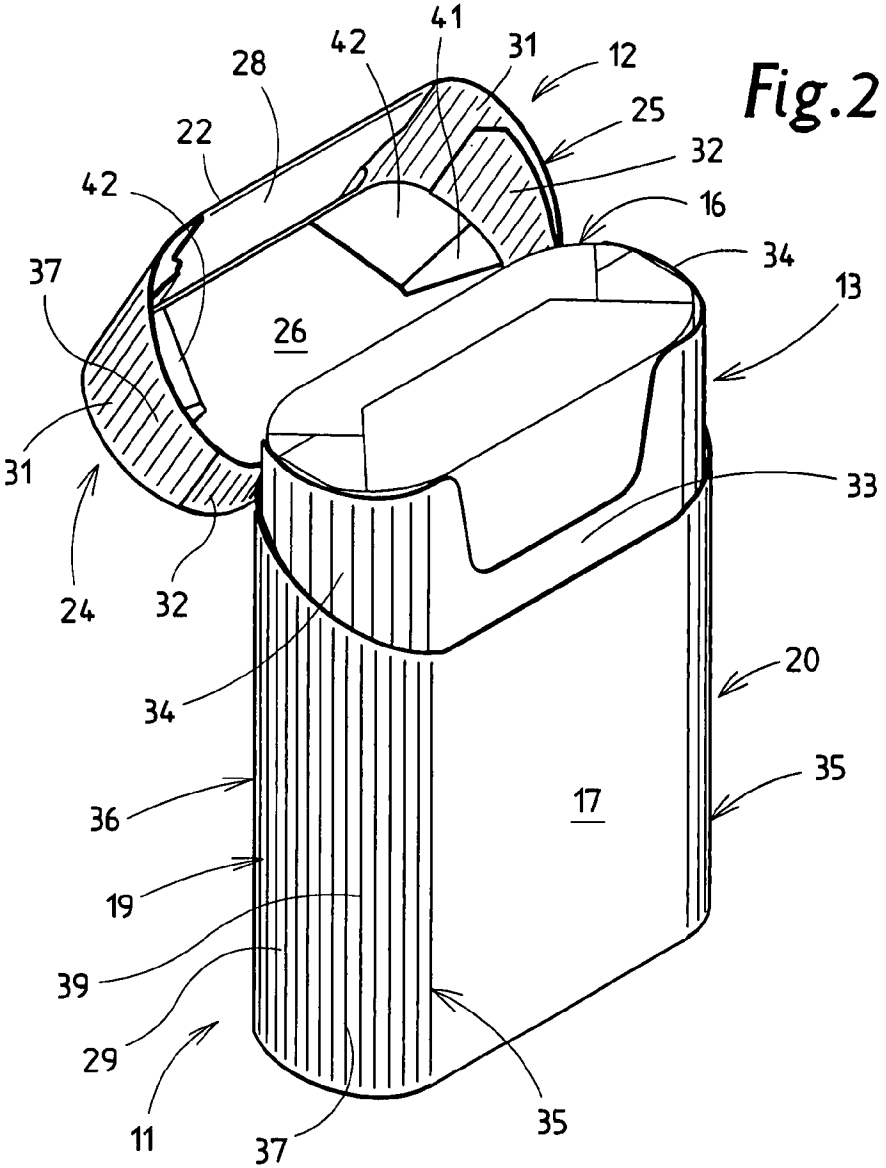
Figure 1:
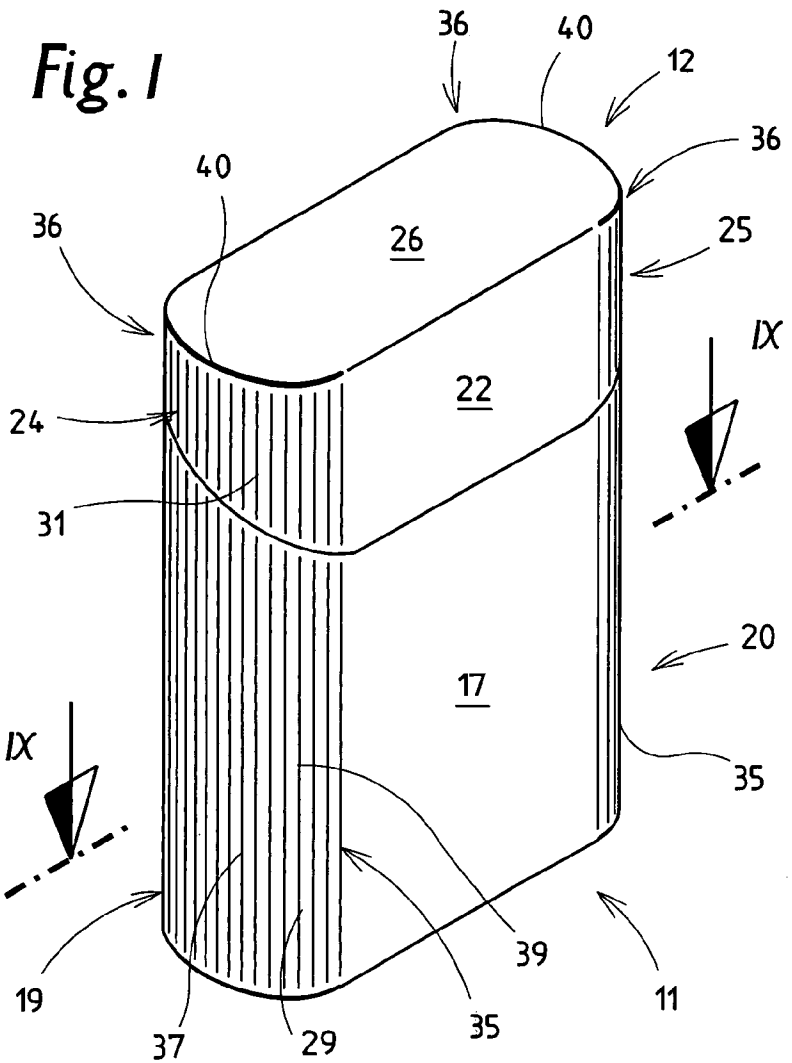
Figure 3:
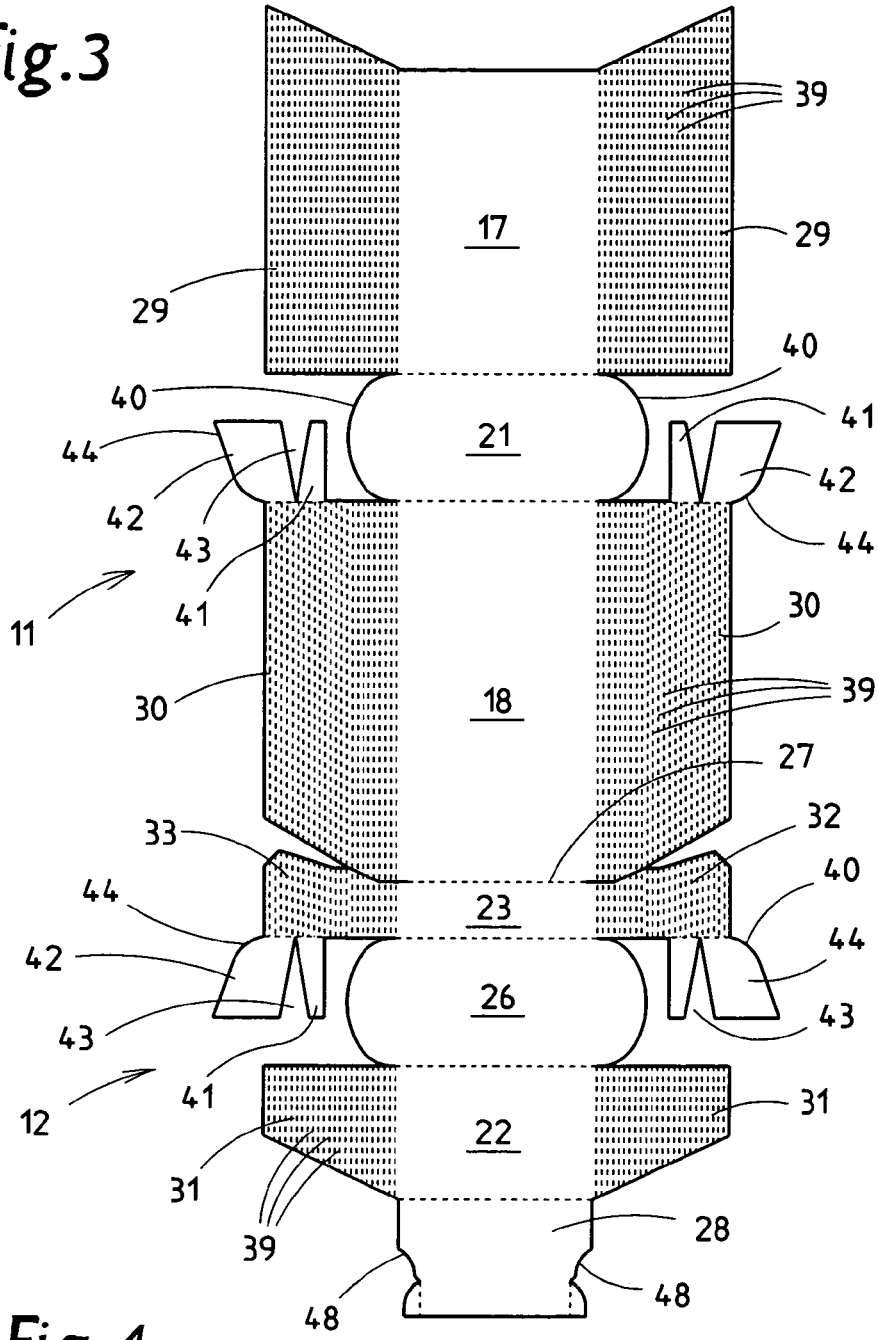
Figure 4:
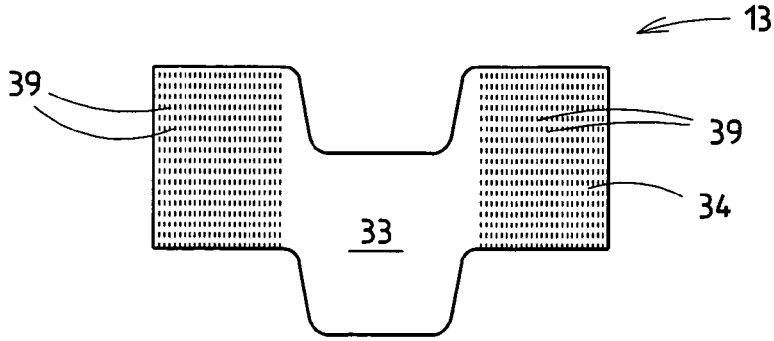
Figure 6:
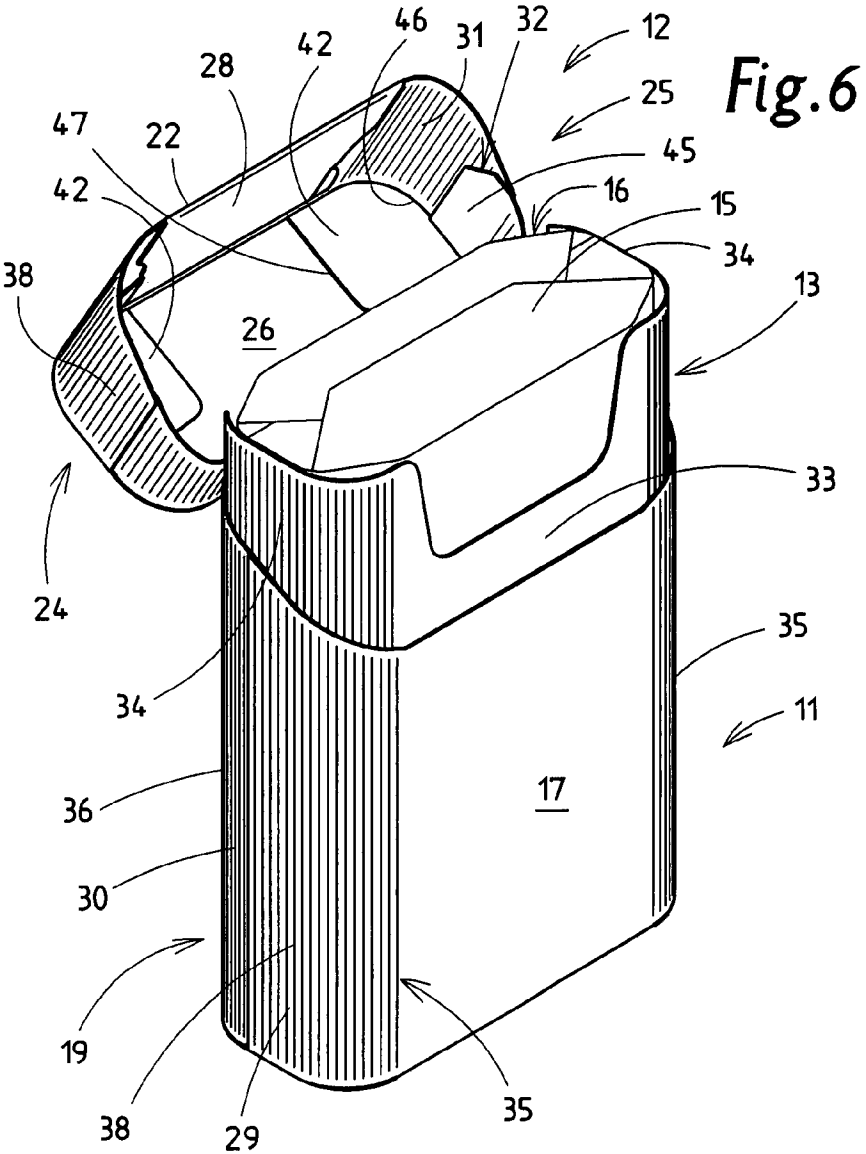
Figure 5:
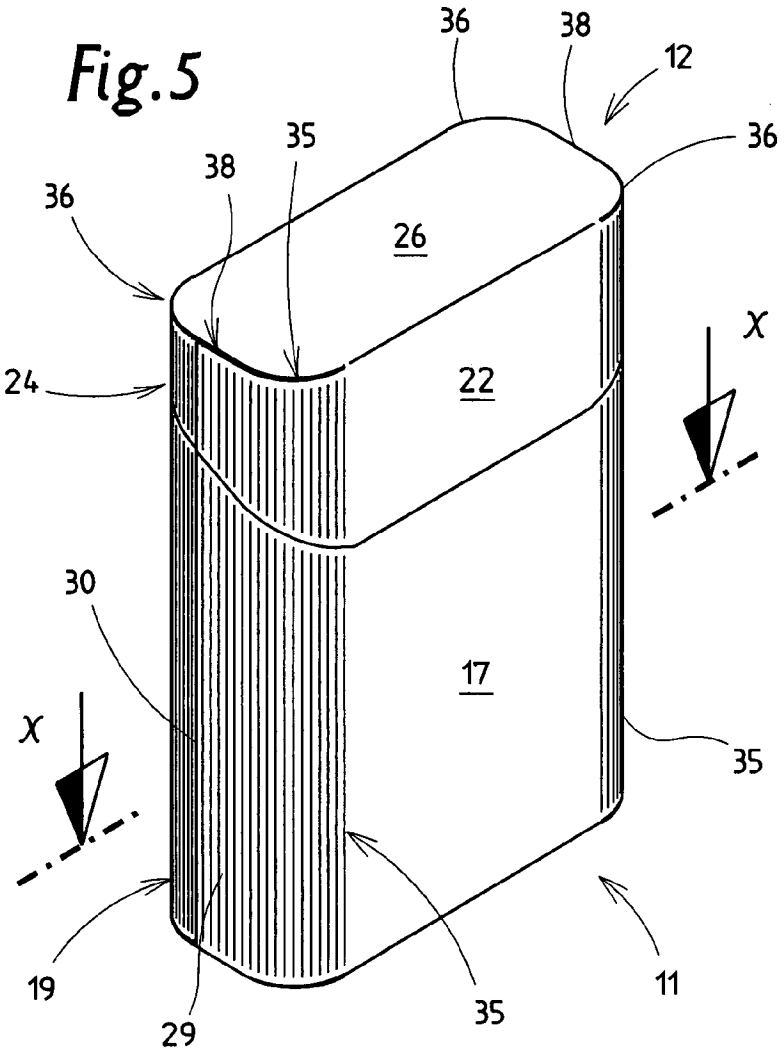
Figure 7:
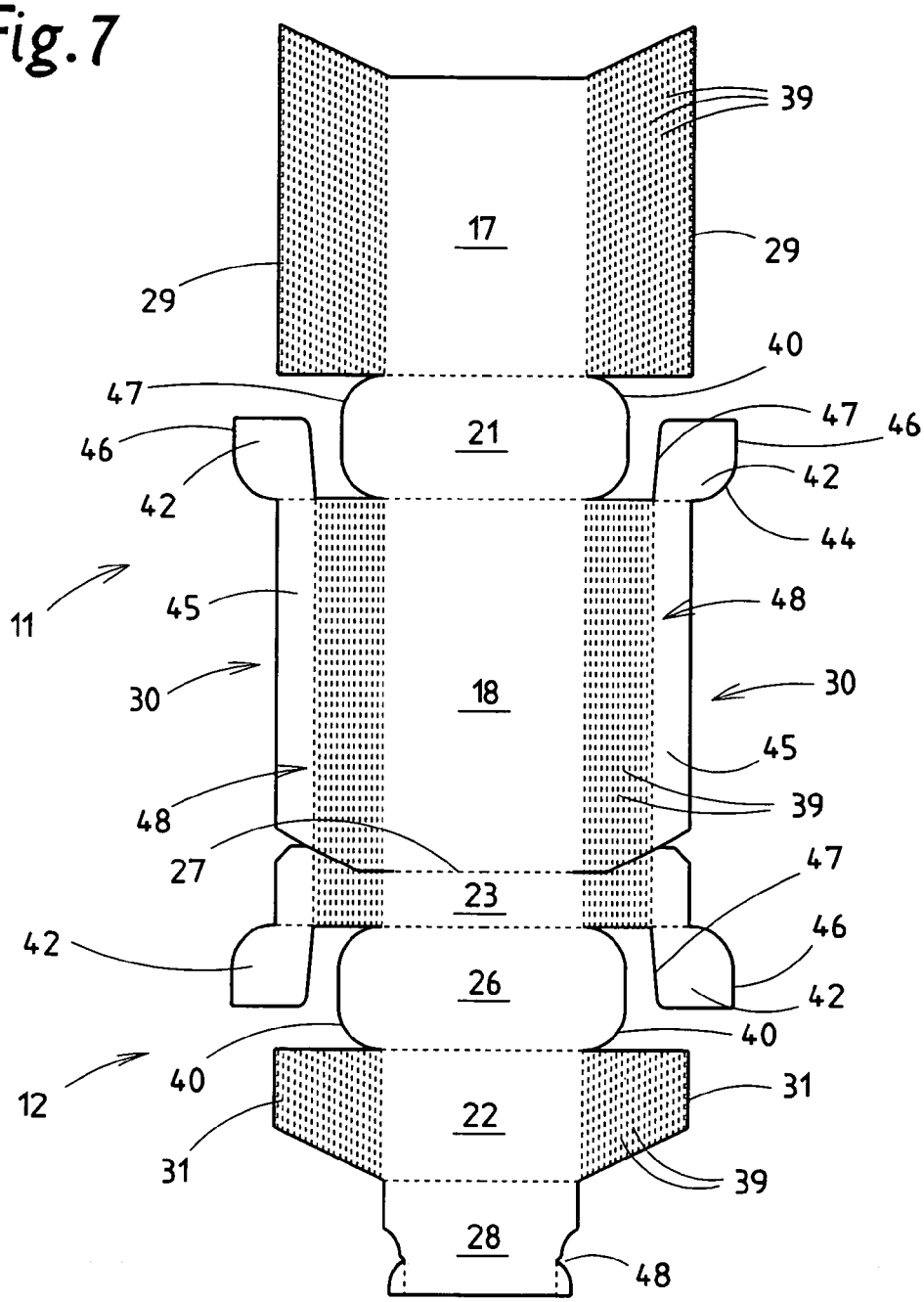
Figure 8:
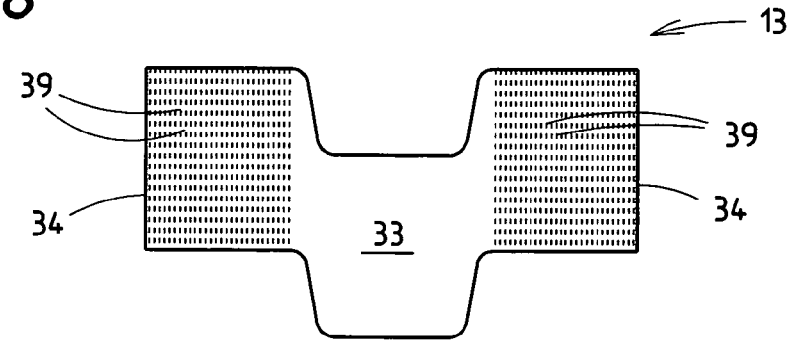
Figure 9:
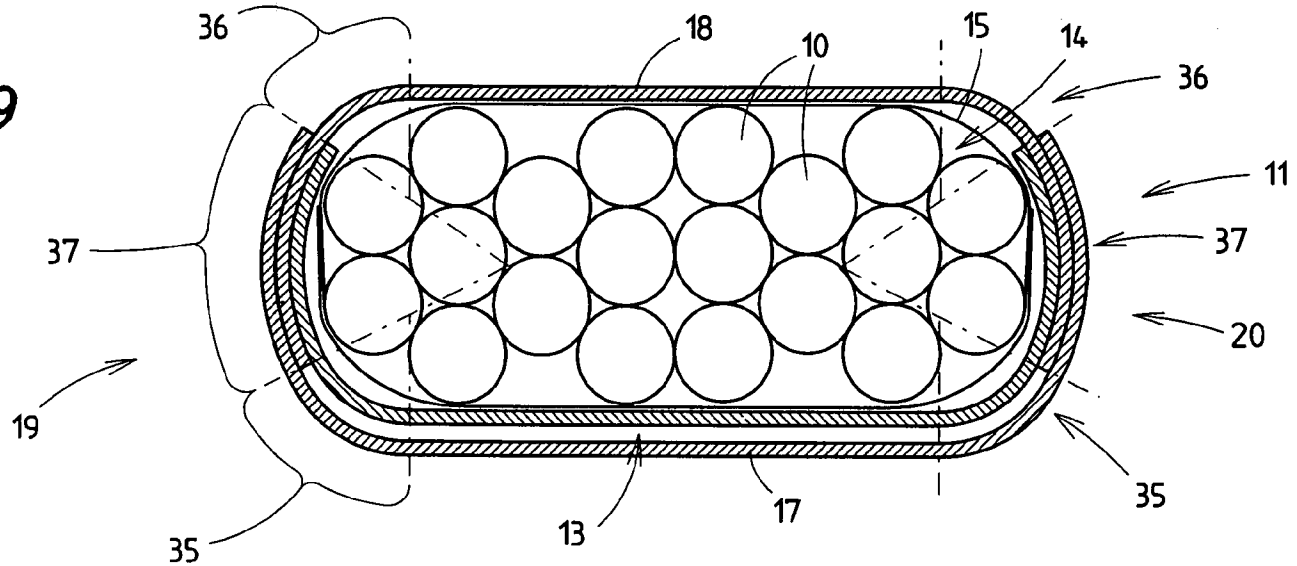
Figure 10:
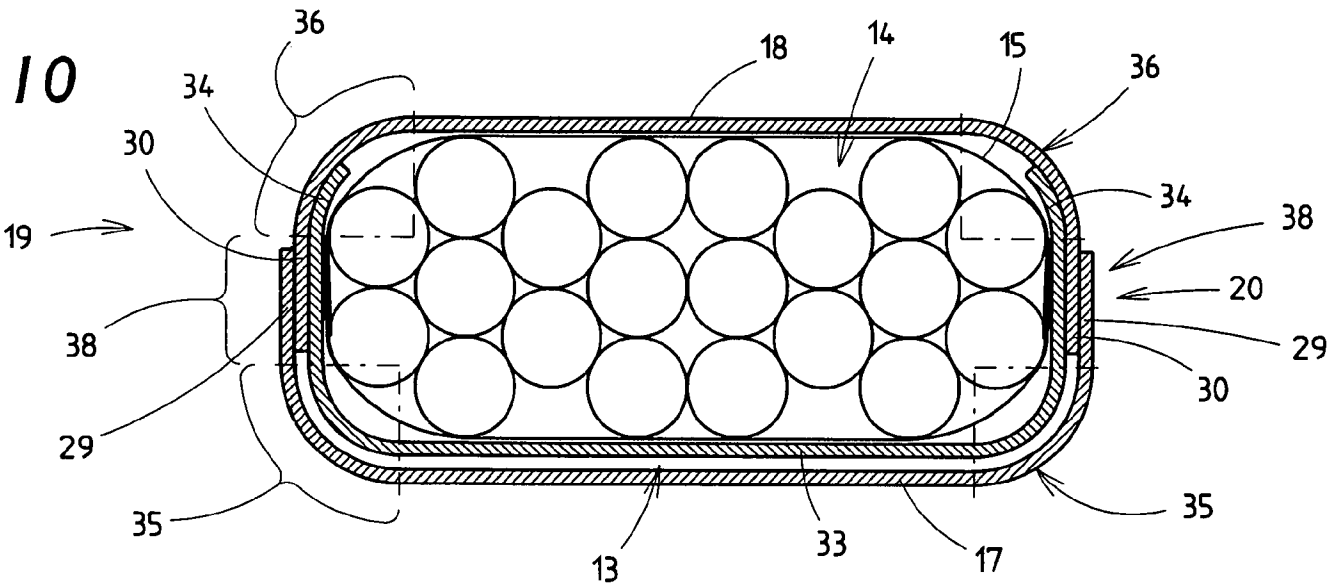

Exemplary embodiments of the packs according to the invention are explained in more detail hereinbelow with reference to the drawings, in which:

FIG. 1 shows a perspective illustration of a rounded hinge-lid box for cigarettes in the closed position, FIG. 2 shows the pack according to FIG. 1 with the lid open, FIG. 3 shows a spread-out, non-folded blank for a pack according to FIGS. 1 and 2, FIG. 4 shows a blank of a collar for a pack according to FIGS. 1 and 2, FIG. 5 shows another exemplary embodiment of a pack in an illustration corresponding to FIG. 1, FIG. 6 shows the pack according to FIG. 5 in the open position, FIG. 7 shows a spread-out, non-folded blank for a pack according to FIGS. 5 and 6, FIG. 8 shows a blank for a collar of the pack according to FIGS. 5 and 6, FIG. 9 shows a pack according to FIGS. 1 and 2 in a horizontal section along section plane IX-IX from FIG. 1, and FIG. 10 shows an illustration analogous to FIG. 9 for the pack according to FIGS. 5 and 6 along section plane X-X from FIG. 5.

The exemplary embodiments shown deal with packs of the hinge-lid-box type for accommodating cigarettes 10. Such a pack comprises a (bottom) box part 11 and a lid 12. The latter is connected in a pivotable manner to the box part 11. This pack also contains a collar 13, which is anchored in the front of the box part 11 and has a top region projecting out of the box part 11.

The pack contents are, namely a cigarette group 14 is, fully enclosed by an inner blank 15 made of tin foil or paper, a cigarette block 16 thus being formed. The pack is usually wrapped in an outer film (not shown), which is wholly or partially removed when the pack is opened for the first time.

The box part 11 comprises a front wall 17, a rear wall 18, side walls 19 and 20 and a base wall 21. Analogously, the lid comprises a lid front wall 22, lid rear wall 23, lid side walls 24, 25 and a top end wall 26. The lid rear wall 23 is connected to the rear wall 18 of the box part 11 via a transversely directed linear articulation 27.

The blank for this type of pack is constructed such that the front wall 17, base wall 21, rear wall 18, lid rear wall 23, end wall 26 and lid front wall 22 successively form a unit. Fitted on the free border of the lid front wall 22 is a customary lid inner tab 28 which, when the pack is finished, is folded against the inside of the lid front wall 22 and is connected to the latter.

The side walls 19, 20 and lid side walls 24, 25 comprise partially overlapping side tabs, namely outer side tabs 29, inner side tabs 30, outer lid side tabs 31 and inner lid side tabs 32.

The collar 13 comprises a separate blank (FIGS. 4 and 8), forming a collar front wall 33 and collar side tabs 34.

One special feature of the packs is the configuration of the side walls 19, 20 and lid side walls 24, 25. These are all rounded, with pronounced rounded portions.

In the case of the exemplary embodiment according to FIGS. 1 to 4 and FIG. 9, the side walls 19, 20 and 24, 25 are all rounded throughout. The side walls 19, 20; 24, 25 comprise rounding regions of different shapes and sizes and with different radii, albeit such that the individual regions merge into one another, and into the associated pack walls, in a step-free manner, namely approximately tangentially.

In the case of a hinge-lid box, customary, upright pack edges 35, 36 are provided with a marked rounded portion. Each of these round pack edges 35, 36 extends —as seen in cross section—over a region which is considerably smaller than that of a quarter-circle. The rounded portion, that is to say the radius of the pack edges 35, 36, is considerably larger than the rounded portion of a cigarette 10, that is to say it has a radius of 6 mm to 10 mm in particular of approximately 8 mm. A round intermediate component, namely a rounding region 37, is formed between the resulting pack edges 35, 36. This rounding region adjoins the rounded portions of the pack edges 35, 36 in a transition-free manner to produce a smooth round shape of the side walls 19, 20; 24, 25 overall. The side walls thus comprise three adjoining rounded portions overall. The central rounding region 37 has a considerably larger radius than the rounded portions of the pack edges 35, 36, namely in the order of magnitude of 15 mm to 20 mm, in particular approximately 17 mm.

The side walls 19, 20; 24, 25 are formed by the side tabs 29, 30; 31, 32. The abovementioned side tabs overlap one another exclusively in the region of the central rounding region 37.

The collar 13 is adapted to the inner shape of the pack, namely parallel to the rounded portions of the front pack edges 35, 36. At the rear, the collar side tabs 34 extend up to the pack edges 35, 36.

In the case of the hinge-lid box according to FIGS. 5 to 9 and 10, the round pack edges 35, 36 are more clearly defined, that is to say they extend precisely over a quarter-circle. These corresponding round pack edges 35, 36 are adjoined by a side strip 38 which, with the pack edges 35, 36, forms the side wall 19, 20 and lid side wall 23, 24. The rounded portions of the pack edges 35, 36 merge tangentially here into the side strip 38, on the one hand, and into the front wall 17, 22 and rear wall 18, 23, on the other hand. The width of the side strip 38 is attained from the transverse dimensions of the pack in dependence on the number of cigarettes 10 and, in the case of the exemplary embodiment shown, is approximately 7 mm to 8 mm. It is also the case with this example that the pack edges have a radius of approximately 8 mm.

The side tabs 29, 30; 31, 32 overlap one another exclusively in the region of the central side strip 38, to be precise only in a central subregion of the same, a spacing of approximately 0.5 mm being left on both sides (FIG. 10).

The blanks for producing the packs are coordinated in a particular way with the shape of the latter. The blank for a pack in the cross-sectional shape of FIG. 9, this blank being shown in FIG. 3, is prepared for the round regions over the entire width of the side tabs 29, 30 and lid side tabs 31, 32, to be precise by virtue of these blank parts being pretreated correspondingly, specifically by the provision of longitudinally running parallel scorings 39, which are introduced by virtue of the blanks being stamped. The blank regions prepared by scoring 39 are defined by dashed parallel lines.

The base wall 21 and end wall 26 are adapted to the cross-sectional contour of the pack (FIG. 9). Lateral borders 40 are rounded, to be precise in accordance with the above described contour of the side walls 19, 20; 24, 25 in FIG. 9, that is to say with a plurality of adjoining rounded portions.

Corner tabs 41, 42, which are assigned to the base wall 21, on the one hand, and the end wall 26, on the other hand, are designed in a particular way. The corner tabs 41, 42 are fitted on the inner side tabs 30 and lid side tabs 32, to be precise—in the initial position—in a free region alongside the base wall 21 and end wall 26.

Each side is assigned two corner tabs 41, 42, which are separated from one another by a wedge-shaped punching 43. When the pack is finished (FIG. 2), the two corner tabs 41, 42 each butt on the inside against the end wall 26, and analogously against the base wall 21, in the region of a side wall 19, 20. The relative position is shown in FIG. 2 with reference to the end wall 26. On account of the rounded portion, on the one hand, and of the V-shaped punching 43, on the other hand, the two corner tabs 41, 42 butt directly against one another without overlapping.

A further special feature is the contour of the corner tab 42, which is assigned in each case to a rounded, front pack edge 35. The essentially trapezoidal corner tab 42 has, on the outside, an initially arcuate and then rectilinear, sloping contour 44. This contour is designed such that the corner tab 42 butts, by way of this contour 44, against the associated round pack edge 35 and adjoining regions of the front wall 17 and lid front wall 22 (FIG. 2). The corner tab 42 thus helps to stabilize the shape of the pack in the region of the front round pack edge 35. The corner tabs 41, 42 are expediently connected to the base wall 21 and end wall 26 by adhesive bonding.

The blank for configuring the pack according to FIG. 10 is designed in a particular way. The outer side tab 29 is provided with scorings 39 over the entire surface area. The inner side tabs 30 are provided with scorings 39 in a rounded region, namely with a scoring strip 49 being formed in the process. A border strip 45 which is free of scorings is located alongside the same. This border strip 45 extends in the region of the side strip 38, that is to say it is not of arcuate configuration. The outer side tab 29 may be designed analogously, that is to say likewise with a scoring-free border strip.

It is also the case with this exemplary embodiment that the corner tabs 42 are designed such that form-fitting positioning on the inside of the base wall 21 and end wall 26 is possible. An outer edge 46 extends in the longitudinal direction of the blank. An inner edge 47 runs in a slightly sloping manner.

The collar 13 (FIG. 8) is designed in the same way as for the exemplary embodiment described above.

In the case of the exemplary embodiments shown, the lid inner tab 28 is provided with a peripheral punched-out portion 48 for the purpose of creating a closing aid for the lid 12, which is known in the case of hinge-lid boxes.

The cigarettes 10 may be formed in various ways within the cigarette pack designed in the above manner. An advantageous arrangement is one according to FIGS. 9 and 10 with transverse rows each with three cigarettes 10 one beside the other or with two cigarettes 10 one beside the other. It is thus possible for the cigarettes 10—with the exception of the region of a central transverse plane—to be placed in a "saddle position", that is to say in an offset manner in relation to one another. Two cigarettes 10 located one beside the other are positioned in each case against the respective side walls 19, 20 and lid side walls 24, 25.

LIST OF DESIGNATIONS

10 Cigarette
11 Box part
12 Lid
13 Collar
14 Cigarette group portion
15 Inner blank
16 Cigarette block
17 Front wall
18 Rear wall
19 Side wall
20 Side wall
21 Base wall
22 Lid front wall
23 Lid rear wall
24 Lid side wall
25 Lid side wall
26 End wall
27 Linear articulation
28 Lid inner tab
29 Side tab (outer)
30 Side tab (inner)
31 Lid side tab (outer)
32 Lid side tab (inner)
33 Collar front wall
34 Collar side tab
35 Pack edge
36 Pack edge
37 Rounding region
38 Side strip
39 Scoring
40 Border
41 Corner tab
42 Corner tab
43 Punching
44 Contour

45 Border strip
46 Outer edge
47 Inner edge
48 Punched-out
49 Scoring strip

The invention claimed is:

1. A cigarette pack of the hinge-lid-box type, comprising a box part (11), a lid (12) connected thereto and a collar (13), the box part (11) and lid (12) having corresponding, upright front and rear pack edges (35, 36) formed as rounded edges with a round cross section, and narrow, upright box side walls (19, 20) and lid side walls (24, 25) consisting of inner and outer box side tabs (29, 30) and lid side tabs (31, 32), respectively, which partially overlap one another and are connected to one another, characterized by the following features:

a) the rounded pack edges (35, 36) have rounded potions which have a radius which is considerably larger than the radius of a cigarette (10), namely 6 mm to 10 mm, b) a narrow intermediate region, namely a planar side strip (38), is formed in a region of the box side walls (19, 20) and the lid side walls (24, 25) between the rounded pack edges (35, 36), said side strip (38) having a width of approximately 7 mm to 8 mm, c) the inner and outer box side tabs (29, 30) and lid side tabs (31, 32) which form the respective box side walls (19, 20) and lid side walls (24, 25) overlap one another only in a region of the side strip (38) and are connected to one another by adhesive bonding in a region of the side strip (38), d) scorings (39) are stamped into the material of the pack in the region of the pack edges (35, 36) for the purpose of forming the rounded pack edges (35, 36), e) the scorings (39) extend across the entire width of the outer box side tabs (29) and lid side tabs (31), including the side strip (38), f) the inner box side tabs (30) and the inner lid side tabs (32) are provided with the scorings (39) in such a manner that an outer border strip (45) is configured without the scorings, g) the inner box side tabs (30) and the inner lid side tabs (32) are connected by adhesive bonding to an inner side of the outer side tabs (29) and lid side tabs (31), respectively, only in a region of the border strip (45), h) a cigarette group (14) is formed in transverse rows as the pack's contents such that each box side wall (19, 20) of the pack faces a transverse row with two adjacent cigarettes (10) and that a transverse row of three adjacent cigarettes (10) is arranged adjacent thereto, and i) the cigarettes (10) of the transverse row of two cigarettes (10) are arranged in an offset manner, that is to say assume a saddle position, with respect to the cigarettes (10) of the transverse row of three cigarettes (10).

2. The cigarette pack according to claim 1, characterized in that corner tabs (41, 42) in a region of a base wall (21) and/or an end wall (26) are designed in terms of contour and size so as to achieve in a folded state an appropriate, form-fitting abutment of an outer edge (46) with a contour (44) against the rounded pack edges (35, 36) and adjacent regions of the box side walls (19, 20) and/or the lid side walls (24, 25).

3. A cigarette pack of the hinge-lid-box type, comprising a box part (11), a lid (12) connected thereto and a collar (13), the box part (11) and lid (12) having corresponding, upright front and rear pack edges (35, 36) formed as rounded edges with a round cross section, and narrow, upright box side walls (19, 20) and lid side walls (24, 25) consisting of inner and outer box side tabs (29, 30) and lid side tabs (31, 32), respectively, which partially overlap one another and are connected to one another, characterized by the following features:

a) the rounded pack edges (35, 36) have rounded portions which have a radius which is considerably larger than the radius of a cigarette (10), namely 6 mm to 10 mm, b) a narrow intermediate region, namely planar side strip (38), is formed in a region of the box side walls (19, 20) and lid side walls (24, 25) between the rounded pack edges (35, 36), said side strip (38) having a width of approximately 7 mm to 8 mm, c) the inner and outer box side tabs (29, 30) and lid side tabs (31, 32) which form the respective box side walls (19, 20) and lid side walls (24, 25) overlap one another on1y in a region of the side strip (38) and are connected to one another by adhesive bonding in a region of the side strip (38), d) scorings (39) are stamped into the material of the pack in the region of the pack edges (35, 36) for the purpose of forming the rounded pack edges (35, 36), e) the scorings (39) extend across the entire width of the outer side tabs (29) and the lid side tabs (31), including the side strip (38), f) the inner box side tabs (30) and the inner lid side tabs (32) are provided with the scorings (39) in such a manner that an outer border strip (45) is configured without the scorings, g) the inner box side tabs (30) and the inner lid side tabs (32) are connected by adhesive bonding to an inner side of the outer box side tabs (29) and lid side tabs (31), respectively, only in a region of the border strip (45), h) corner tabs (41, 42) in the region of a base wall (21) and an end wall (26) are designed in terms of contour and size so as to achieve, in the folded state an appropriate, form-fitting abutment of an outer edge (46) with a contour (44) against the rounded pack edges (35, 36) and adjacent regions of the box side walls (19, 20) and the lid side walls (24, 25)

i) the corner tabs (41, 42) are connected to the inner box side tabs (30) and lid side tabs (32) exclusively in the region of the border strip (45) free of the scorings, and j) the collar (13), arranged in the box part (11) and projecting out of the latter with a partial region, is provided with lateral collar side tabs (34) with the scorings (39) across its full width.

4. A cigarette pack of the hinge-lid-box type, comprising a box part (11), a lid (12) connected thereto and a collar (13), the box part (11) and lid (12) having corresponding, upright front and rear pack edges (35, 36) formed as rounded edges with a round cross section, and narrow, upright box side walls (19, 20) and lid side walls (24, 25) consisting of inner and outer box side tabs (29, 30) and lid side tabs (31, 32), respective, which partially overlap one another and are connected to one another, characterized by the following features:

a) the pack edges (35, 36) have rounded led portions which have a radius which is considerably larger than the radius of a cigarette (10), namely 6 mm to 10 mm, b) a narrow intermediate region, namely a planar side strip (38), is formed in the a region of the box side walls (19, 20) and the lid side walls (24, 25) between the rounded pack edges (35, 36), said side strip (38) having a width of approximately 7 mm to 8 mm, c) the inner and outer box side tabs (29, 30) and lid side tabs (31, 32) which form the respective box side walls (19, 20) and lid side walls (24, 25) overlap one another only in a region of the side strip (38) and are connected to one another by adhesive bonding in a region of the side strip (38), d) scorings (39) are stamped into the material of the pack in a region of the pack edges (35, 36) for the purpose of forming the rounded pack edges (35, 36), e) the scorings (39) extend across the entire width of the outer box side tabs (29) and lid side tabs (31), including the side strip (38), f) the inner box side tabs (30) and the inner lid side tabs (32) are provided with the scorings (39) in such a manner that an outer border strip (45) is configured without the scorings, g) the inner box side tabs (30) and the inner lid side tabs (32) are connected by adhesive bonding to an inner side of the outer box side tabs (29) and lid side tabs (31), respectively, only in a region of the border strip (45), h) corner tabs (41, 42) in a region of a base wall (21) and an end wall (26) are designed in terms of contour and size so as to achieve, in a folded state an appropriate, form-fitting abutment of an outer edge (46) with a contour (44) against the rounded pack edges (35, 36) and adjacent regions of the box side walls (19, 20) and the lid side walls (24, 25)

i) the corner tabs (41, 42) are connected to the inner box side tabs (30) and lid side tabs (32) exclusively in a region of the border strip (45) free of the scorings, j) the collar (13), arranged in the box part (11) and projecting out of the latter with a partial region, is provided with lateral collar side tabs (34) with the scorings (39) across its full width, k) a cigarette group (14) is formed in transverse rows as the pack's contents such that each box side wall (19, 20) of the pack faces a transverse row with two adjacent cigarettes (10) and that a transverse row of three adjacent cigarettes (10) is arranged adjacent thereto, and l) the cigarettes (10) of the transverse row of two cigarettes (10) are arranged in an offset manner, that is to say assume a saddle position, with respect to the cigarettes (10) of the transverse row of three cigarettes (10).

* * * * *